US008146570B2

(12) United States Patent
Ishida et al.

(10) Patent No.: US 8,146,570 B2
(45) Date of Patent: Apr. 3, 2012

(54) FUEL SYSTEM FOR VEHICLE WITH ENGINE

(75) Inventors: Yuuki Ishida, Nishinomiya (JP); Hiroshi Shimada, Nara (JP)

(73) Assignee: Kubota Corporation, Osaka (JP)

( * ) Notice: Subject to any disclaimer, the term of this patent is extended or adjusted under 35 U.S.C. 154(b) by 201 days.

(21) Appl. No.: 12/556,234

(22) Filed: Sep. 9, 2009

(65) Prior Publication Data

US 2010/0206272 A1 Aug. 19, 2010

(30) Foreign Application Priority Data

Feb. 19, 2009 (JP) ..... 2009-036873

(51) Int. Cl.
*F02M 33/04* (2006.01)

(52) U.S. Cl. ..... 123/516; 123/518; 123/520

(58) Field of Classification Search ..... 123/516, 123/518, 519, 520, 521
See application file for complete search history.

(56) References Cited

U.S. PATENT DOCUMENTS

| | | | | |
|---|---|---|---|---|
| 5,392,804 | A * | 2/1995 | Kondo et al. | 137/202 |
| 5,404,906 | A * | 4/1995 | Aoshima et al. | 137/587 |
| 5,474,048 | A * | 12/1995 | Yamazaki et al. | 123/519 |
| 5,687,778 | A * | 11/1997 | Harris | 141/59 |
| 6,176,259 | B1 * | 1/2001 | Harde et al. | 137/587 |
| 6,698,402 | B2 * | 3/2004 | Biesinger et al. | 123/520 |
| 7,213,584 | B2 * | 5/2007 | Ohhashi et al. | 123/519 |
| 7,377,295 | B2 * | 5/2008 | Byers et al. | 141/98 |
| 7,762,240 | B2 * | 7/2010 | Callahan et al. | 123/518 |
| 7,866,356 | B2 * | 1/2011 | Benjey | 141/198 |
| 7,886,723 | B2 * | 2/2011 | Marushima et al. | 123/519 |
| 2002/0046740 | A1 * | 4/2002 | Biesinger et al. | 123/520 |
| 2002/0066440 | A1 * | 6/2002 | Kano et al. | 123/520 |
| 2005/0005916 | A1 * | 1/2005 | Powell et al. | 123/519 |
| 2005/0022796 | A1 * | 2/2005 | Zuchara | 123/519 |
| 2007/0193561 | A1 * | 8/2007 | Benjey | 123/518 |

FOREIGN PATENT DOCUMENTS

| | | |
|---|---|---|
| JP | 05332207 | 12/1993 |
| JP | 2008144607 | 6/2008 |

* cited by examiner

*Primary Examiner* — Erick Solis
(74) *Attorney, Agent, or Firm* — The Webb Law Firm

(57) ABSTRACT

A fuel system for a vehicle with an engine includes: a fuel tank for storing fuel: first and second ports disposed on a wall of the fuel tank, between which wall and a fuel fluid level a clearance is created when the fuel is contained in an allowable maximal amount in the fuel tank of the vehicle in a horizontal state, the first and second ports being positioned frontward and rearward, respectively, in a longitudinal direction of the vehicle, and the first port and the second port being out of alignment in a lateral direction; a canister for adsorbing and releasing a fuel vapor; an inflow line for sending the fuel vapor generated in the fuel tank to the canister through the first and second ports; and a discharge line for sending the fuel vapor from the canister to an air-intake path to the engine.

7 Claims, 9 Drawing Sheets

FUEL SYSTEM FOR VEHICLE WITH ENGINE

BACKGROUND OF THE INVENTION

1. Field of the Invention

The present invention relates to a fuel system for a vehicle with an engine, particularly to a fuel system which has a canister for adsorbing a fuel vapor (evaporated gas) generated in a fuel tank, and discharges the fuel vapor adsorbed to the canister to an air-intake path leading to the engine.

2. Description of the Related Art

In order to comply with regulations for fuel vapor emission, there has been known a fuel system which has a canister for adsorbing a fuel vapor from a fuel tank and discharges the fuel vapor adsorbed to the canister to an air-intake path leading to the engine, as disclosed in Japanese patent application JP2008-144607A (see paragraphs 0038 and 0039 and FIG. 3) and Japanese patent application JPS-332207A (see paragraphs 0016 to 0018 and FIG. 2). In the vehicles to which such a fuel system is applied, the fuel vapor whose emission amount is set in accordance with operational conditions of the engine is sent to the engine air-intake path, and then appropriately combusted in the engine. These days, such a fuel system is beginning to be applied to utility vehicles, agricultural vehicles, industrial vehicles and the like.

In such a conventional fuel system, only a single pipe is present that connects the fuel tank and the canister. For this reason, when the vehicle runs or stops on a slope and is inclined relative to a horizontal plane, and in turn the fuel tank is inclined, as shown in FIG. 13 of the present application illustrating the prior art, the pipe may be blocked by a fuel in a form of liquid (hereinafter referred to as "liquid fuel") LF. In this situation, when evaporation of the liquid fuel LF in the fuel tank 2 advances due to raise in an ambient temperature or the like, the fuel vapor (fuel in a gas state) EG generated in the fuel tank 2 cannot escape from the fuel tank 2, leading to increase in an inner pressure of the fuel tank 2. As a result, the liquid fuel LF may reach the canister 3 along the pipe and the canister 3 may disadvantageously be soaked with the liquid fuel LF. The canister 3 soaked with the liquid fuel LF in this manner cannot adsorb the fuel vapor EG.

SUMMARY OF THE INVENTION

In view of the above, the object of the present invention is to provide a fuel system with a simple and low-cost structure for adjusting the emission amount of the fuel vapor to the atmosphere with high reliability, while retaining the function of the canister.

In order to attain the object described above, a fuel system for a vehicle with an engine according to the present invention includes: a fuel tank configured to store fuel: a first port and a second port disposed on a boundary wall of the fuel tank, between which boundary wall and a fluid level of the fuel a clearance is created when the fuel is contained in an allowable maximal amount in the fuel tank of the vehicle in a horizontal state, the first port being positioned frontward in a longitudinal direction of the vehicle, the second port being positioned rearward in the longitudinal direction of the vehicle, and the first port and the second port being out of alignment in a lateral direction of the vehicle; a canister configured to adsorb and release a fuel vapor; an inflow line configured to send the fuel vapor generated in the fuel tank to the canister through the first port and the second port; and a discharge line configured to send the fuel vapor discharged from the canister to an air-intake path to the engine.

According to this configuration, even when the fuel tank is inclined at least one of longitudinal and lateral directions, either of the first port or the second port is opened at a high position in the fuel container space of the fuel tank. Since a clearance is created between the fluid level of the liquid fuel and a plane of an opening of at least one of the first port and the second port, there is only a small possibility that the opening of the port is blocked by the liquid fuel. In addition, in the vicinity of the opening (port) which is not blocked by the liquid fuel, a gas containing the fuel vapor is to be present. This means that at least one of the ports of the fuel tank is opened so as to communicate with the canister 3.

In short, in the fuel system according to the present invention, even when the fuel tank is inclined at least one of the longitudinal and lateral directions, the fuel vapor generated in the fuel tank is sent to the canister, and thus the inner pressure of the fuel tank will not be increased. As a result, a risk of the liquid fuel entering the canister can be surely suppressed. In spite of the simple and low-cost structure, the fuel system according to the present invention retains the excellent function of the canister and complies with the regulations for fuel vapor emission, even when the work vehicle is in an inclined state.

In a case where the fuel exceeding the allowable amount is unexpectedly put in the fuel tank, when the fuel tank is inclined even to a small degree, both of the first port and second port may be blocked by the liquid fuel. In this situation, when the fuel vapor is kept generated in the fuel tank due to raise in an ambient temperature or the like, the fuel vapor in the fuel tank cannot escape from the fuel tank, leading to increase in an inner pressure of the fuel tank. As a result, the liquid fuel may disadvantageously enter the canister. In order to surely prevent this, it is desirable to provide a valve operating mechanism on a line (flow passage) connecting both ports to the canister, that allows the fuel vapor to pass through the line, but prevents the liquid fuel from passing through the line. In this case, it is preferable that a line from the first port and a line from the second port join together as a confluent line to be connected to the canister and the valve operating mechanism is provided on the confluent line, since only a single valve operating mechanism is necessary.

Typically, on an air-intake path to the engine, an on-off valve is provided for adjusting an intake volume from an air cleaner to the engine. In one preferred embodiment of the present invention, the discharge line is a fuel vapor discharge pipe with one end (canister-side end) thereof being connected to the canister, and the other end (fuel tank-side end) being connected to the air-intake path at a point upstream of the on-off valve in a flow direction of intake air.

Typically, when the engine is operated with a lower load, an air-fuel ratio is set on a lean side, which is near an ideal air-fuel ratio, for the purpose of improving fuel consumption. However, when an unnecessary fuel vapor is discharged to the air-intake path to the engine, incomplete combustion occurs and CO or the like is generated. For this reason, the emission amount of the fuel vapor is electronically controlled in accordance with an operational condition of the engine. It should be noted that, even when the engine is operated with a higher load, introduction of some fuel vapor does not cause any problem, since the air-fuel ratio is originally set on a rich side.

When the engine is operated with a lower load, an opening degree of the on-off valve becomes small, and thus an intake volume to the engine is suppressed. When the engine performs an air-intake step, a negative pressure is exerted at a point in the air-intake path downstream of the on-off valve, i.e., on an engine side. However a portion of the air-intake path upstream of the on-off valve is not likely to be affected by the air-intake step of the engine, and thus a degree of the negative pressure is smaller as compared with the downstream side.

Like this preferable embodiment, when the fuel vapor adsorbed to the canister is released to a point in the air-intake path upstream of the on-off valve, the upstream side is not likely to be affected by the negative pressure during a low-load operation of the engine. In addition, since the opening degree of the on-off valve is small, entry of the fuel vapor into a point downstream of the on-off valve in the air-intake path is suppressed. Therefore, introduction of an unnecessary fuel vapor to the engine can be suppressed. On the other hand, during a high-load operation in which the opening degree of the on-off valve is large, the air-intake path opens wide, and the most of the fuel vapor, together with the intake air, is introduced to the engine. However, as described above, introduction of some fuel vapor does not cause any problem, since an air-fuel ratio is set on a rich side. In this manner, while retaining the normal function of the canister, by utilizing the negative pressure on the engine side, the emission amount of the fuel vapor can be adjusted in accordance with the operational conditions of the engine, with a simple and low-cost structure.

Other features and advantages of the present invention will be apparent from the following descriptions of the embodiments with reference to the drawings.

DETAILED DESCRIPTION OF THE PREFERRED EMBODIMENTS

Hereinbelow, preferred embodiments of the present invention will be described with reference to the accompanied drawings. Features of one embodiment can be used in combination with features of another embodiment, and such combinations are encompassed in the scope of the present invention, as long as the combination does not create inconsistency.

Hereinbelow, an embodiment of the fuel system according to the present invention will be described with reference to the drawings, while illustrating a utility vehicle (hereinafter, simply referred to as "UV") having an engine using gasoline as fuel, to which the fuel system is applied.

(Entire Configuration)

Figure 1:
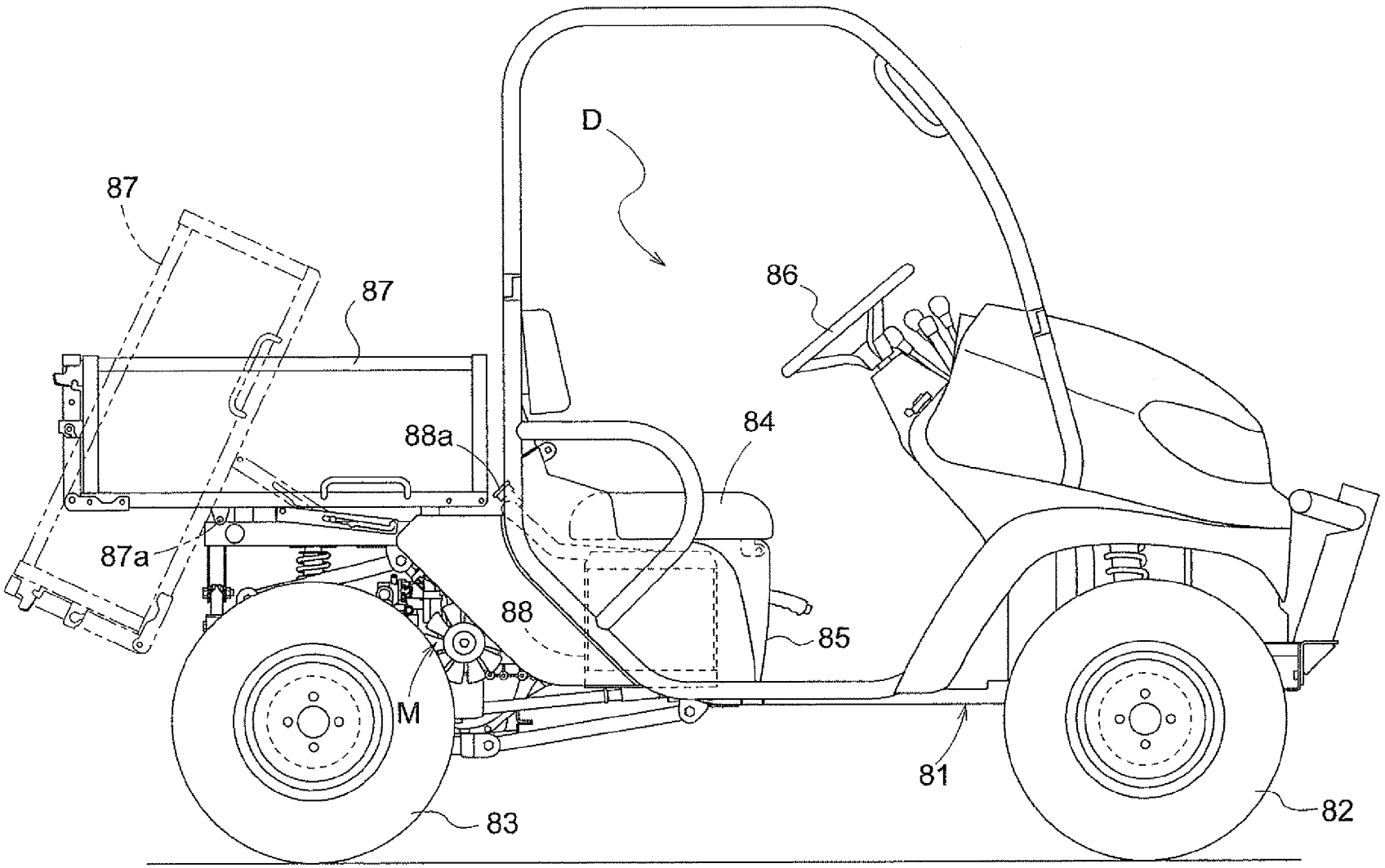
FIG. 1 is a side view of a work vehicle.
Figure 2:
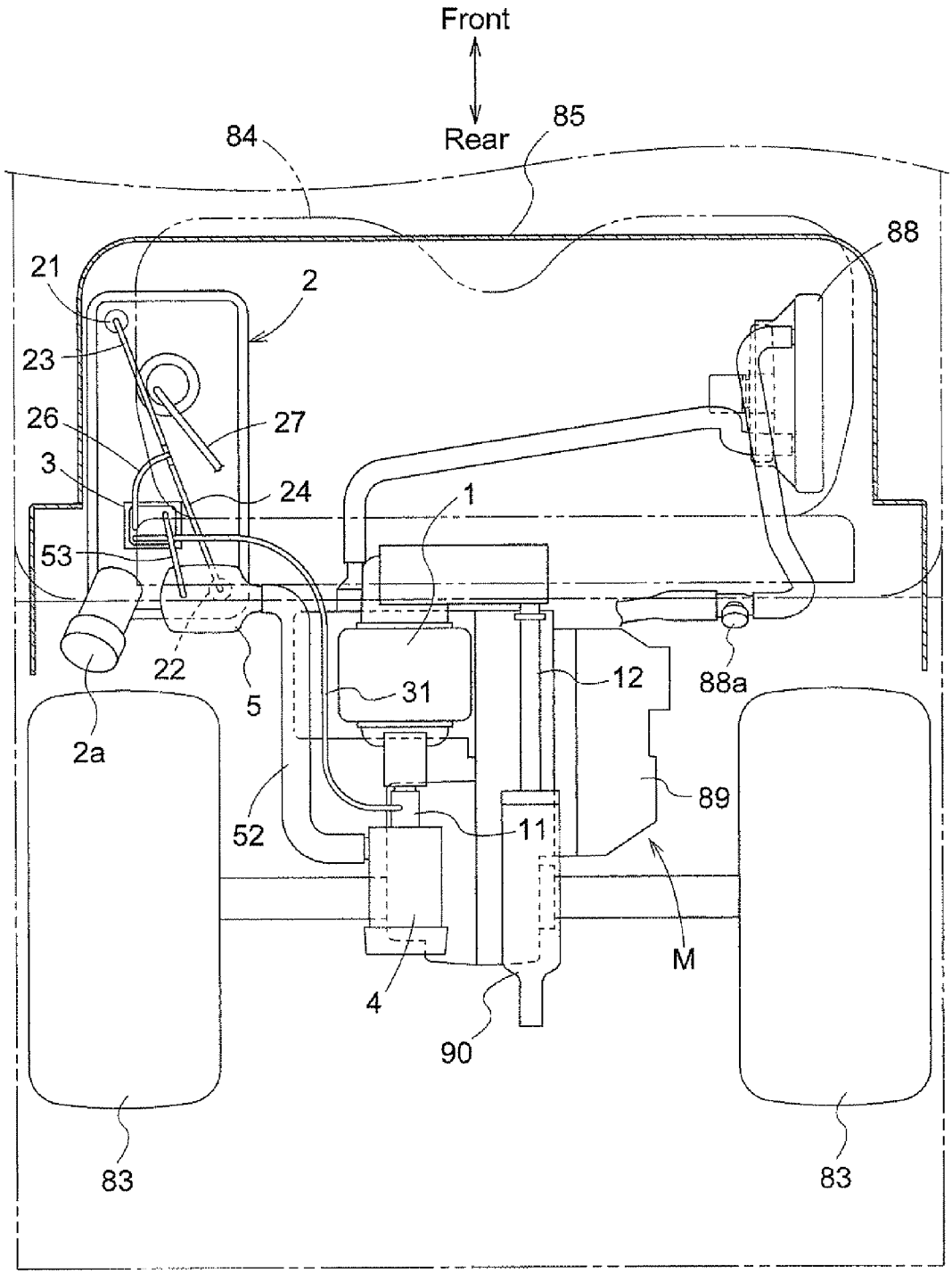
FIG. 2 is a horizontal sectional plan view of an engine and surroundings thereof of the work vehicle.

As shown in FIGS. 1 and 2, the UV has a pair of right and left steerable front wheels 82 and a pair of right and left rear wheels 83. The front and rear wheels 82,83 are disposed on front and rear portions of a body frame 81, respectively. Between the front and rear wheels 81,82, a driver's cabin D and a motor part M are provided. The UV also has a loading platform 87 in the rear portion of the body frame 81. The loading platform 87 is swingable about a shaft center 87*a* extending in a lateral direction of a vehicle body in the rear end portion of the body frame 81.

Figure 4:
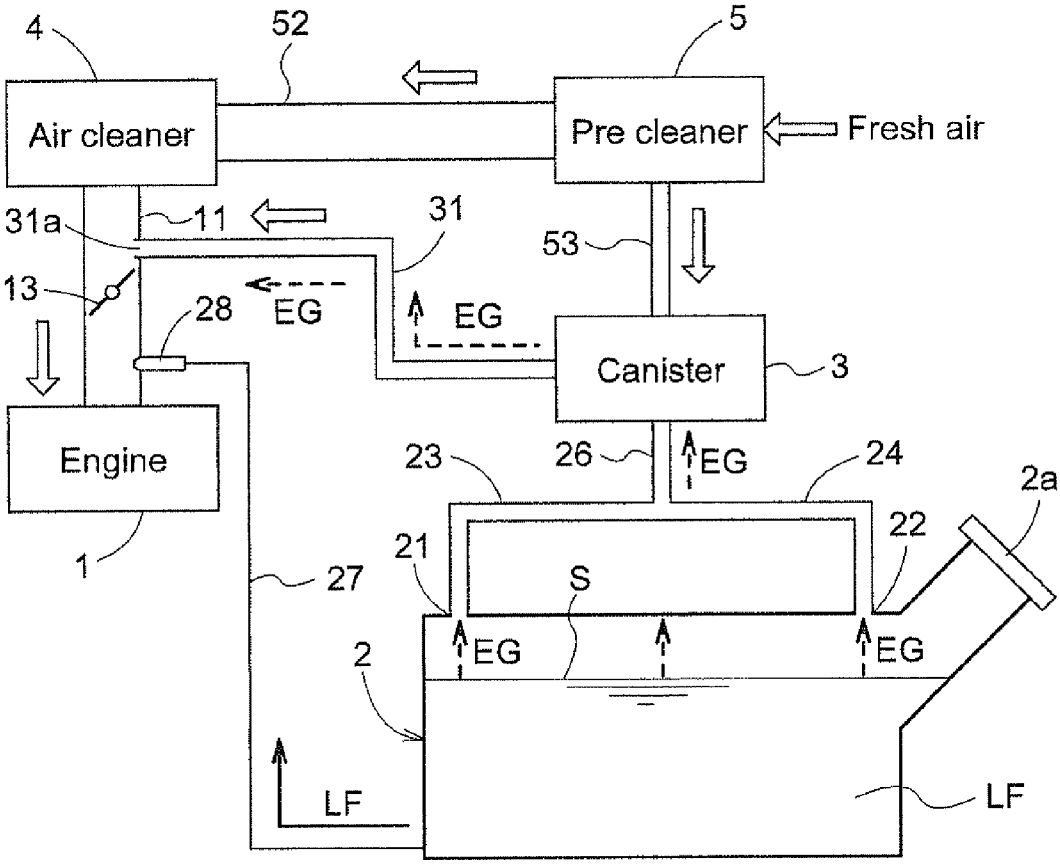
FIG. 4 is a block diagram showing a configuration of a fuel tank and surroundings thereof of the work vehicle.

As shown in FIGS. 2 and 4, the UV includes: a fuel tank 2 for storing gasoline LF as liquid fuel; a canister 3; an air cleaner 4 for supplying combustion air to an engine 1; and a pre-cleaner 5 positioned upstream of the air cleaner 4 in a flow direction of intake air. The fuel vapor (hereinafter, referred to as "evaporated gas EG") from the fuel tank 2 is adsorbed to the canister 3, and together with air cleaned in the pre-cleaner 5, is discharged to an air-intake path from the air cleaner 4 to the engine 1.

(Driver's Cabin)

As shown in FIG. 1, the driver's cabin D is provided with a steering wheel 86 on a front side of the vehicle body and a seat 84 on a rear side. The seat 84 is mounted on a seat mounting rack 85 fixed to the body frame 81, and is swingably liftable about an upper front end of the seat mounting rack 85 as a fulcrum.

Figure 3:
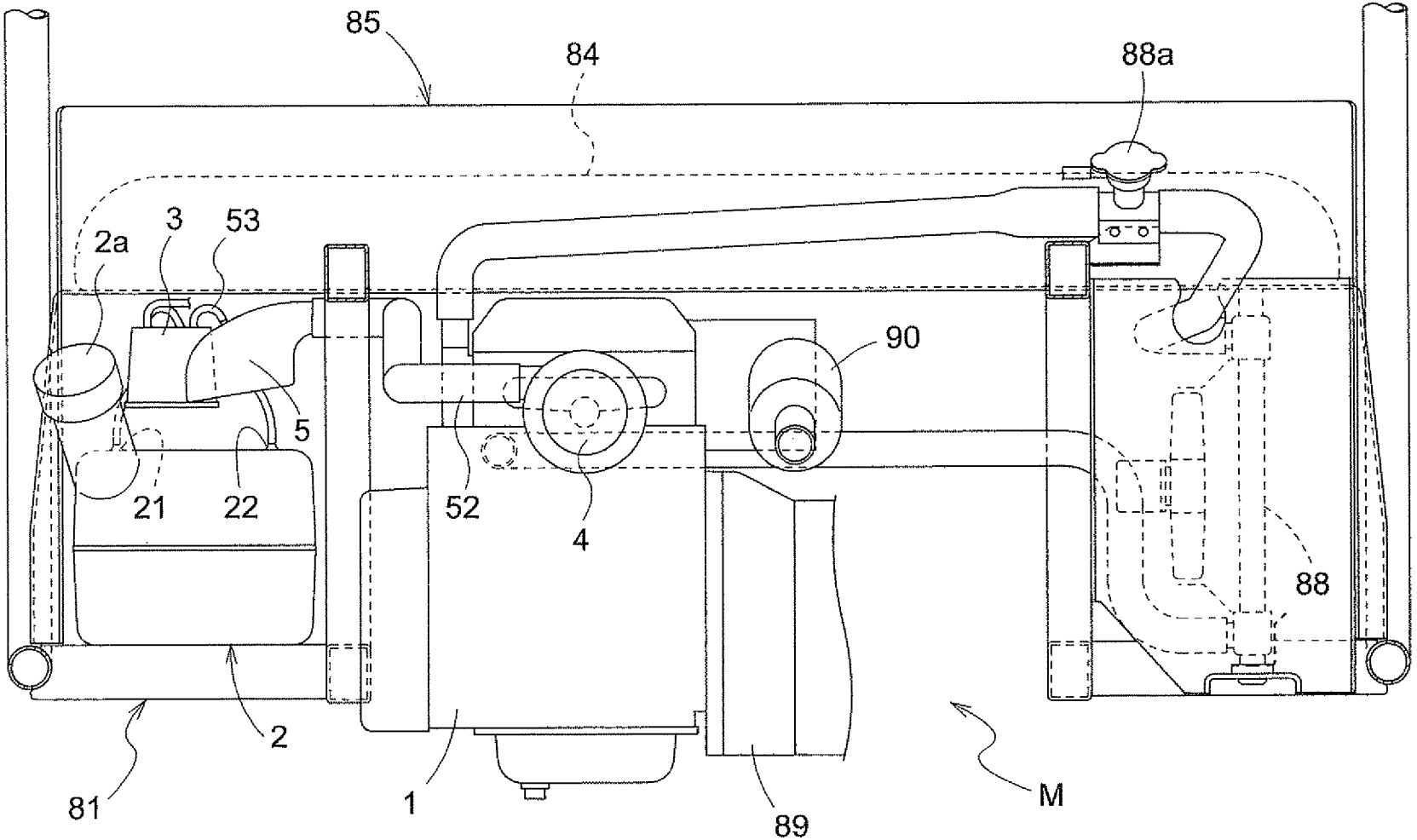
FIG. 3 is a vertical sectional rear view of the engine and the surroundings thereof of the work vehicle.

As shown in FIGS. 2 and 3, a radiator 88 is disposed on a right side in a space below the seat mounting rack 85, and the fuel tank 2 is disposed on a left side in the space. A predetermined distance is provided between an air-intake face of the radiator 88 and a right wall of the seat mounting rack 85 so that the radiator 88 can take in ambient air. The radiator 88 can take in ambient air from a lower side and a rear side of the vehicle body by a suction action of a radiator fan (not shown) disposed on an inner side of the vehicle body relative to the radiator 88. It should be noted that the seat mounting rack 85 extends rearward so as to cover the radiator 88 from a lateral side, and thus serves as an exterior member of the vehicle body.

(Motor Part)

As shown in FIGS. 2 and 3, the motor part M includes the engine 1 of a water-cooled type and a transmission case 89. The engine 1 and the transmission case 89 are disposed between the fuel tank 2 and the radiator 88 in the lateral direction and rearward of the fuel tank 2 and the radiator 88 in a longitudinal direction. In addition, the engine 1 is disposed on the left side, while the transmission case 89 is disposed on the right side, and thus they are placed side by side in a rear portion of a space below the driver's cabin D. An output from the transmission case 89 is transmitted to the front and rear wheels 82,83.

In other words, the space for installing the engine 1 and the transmission case 89 is more compact in the longitudinal direction of the vehicle body as compared with the case where they are arranged in tandem. At the same time, both the engine 1 and the transmission case 89 are out of alignment with the fuel tank 2 and the radiator 88, both in the longitudinal direction and lateral direction of the vehicle body, as a planar view. Accordingly, the motor part M is made compact in the longitudinal direction of the vehicle body.

As shown in FIGS. 1 and 2, a feed-water inlet 88*a* of the radiator 88 is positioned in a space below the loading platform 87, or a space spanning below the loading platform 87 and the seat 84. Therefore, when the loading platform 87 is lowered as in a regular running state, opening and closing operations of the feed-water inlet 88*a* becomes impossible. Accordingly, improper opening and closing operations of the feed-water inlet 88*a* by a third person can be prevented. When the opening and closing operations of the feed-water inlet 88*a* is desired, the loading platform 87 is lifted about the shaft center 87*a* to thereby expose a space around the feed-water inlet 88*a*.

As shown in FIGS. 2 and 3, a muffler 90 oriented to a rear side of the vehicle body is provided above the transmission case 89. An end portion of an exhaust stack of the muffler 90 is equipped with a spark arrester (not shown) for removing spark from exhaust.

(Air Cleaner and Pre-cleaner)

The UV has the air cleaner 4 and the pre-cleaner 5, and is configured to clean combustion air to be sent to the engine 1. Since the UV has the air cleaner 4 and the pre-cleaner 5, as compared with the UV having only the air cleaner 4, combustion air to be sent to the engine 1 can be cleaned more. As shown in FIG. 1, the UV does not have a bonnet, and spaces below the seat mounting rack 85 and below the loading platform 87 are opened to the ground, and thus are exposed to external dust or a large amount of scattering mud. Even when the UV is put in such an environment, the combustion air appropriately cleaned can be introduced to the engine 1.

As shown in FIG. 2, below the loading platform 87, the air cleaner 4 is arranged rearward of the engine 1 in tandem. The air cleaner 4 and the engine 1 are communicated with each other through a second air-intake pipe 11 as air-intake path, and the cleaned combustion air is sent from the air cleaner 4 to the engine 1.

Figure 7:
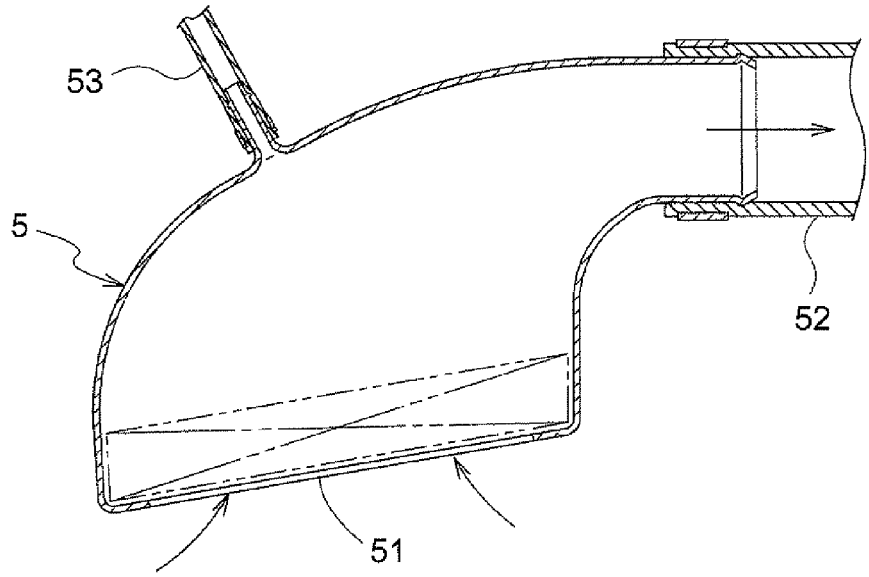
FIG. 7 is a vertical sectional rear view of a pre-cleaner of the work vehicle.

The pre-cleaner 5 is positioned upstream of the air cleaner 4 in the flow direction of intake air, and is connected to the air cleaner 4 through a first air-intake pipe 52. As shown in FIGS. 2 and 7, in the pre-cleaner 5, an ambient air inlet 51 oriented downward faces an upper face of the fuel tank 2 and is positioned rearward relative to the fuel tank 2. In other wards, when seen from the bottom, the entire or the most portions of the ambient air inlet 51 hide behind the fuel tank 2. As a result, there can be reduced scattering substances from the ground that directly intrude into or adhere to the ambient air inlet 51. In addition, since the ambient air inlet 51 is oriented downward, washing water is prevented from entering the pre-cleaner 5 when the vehicle is washed.

Figure 5:
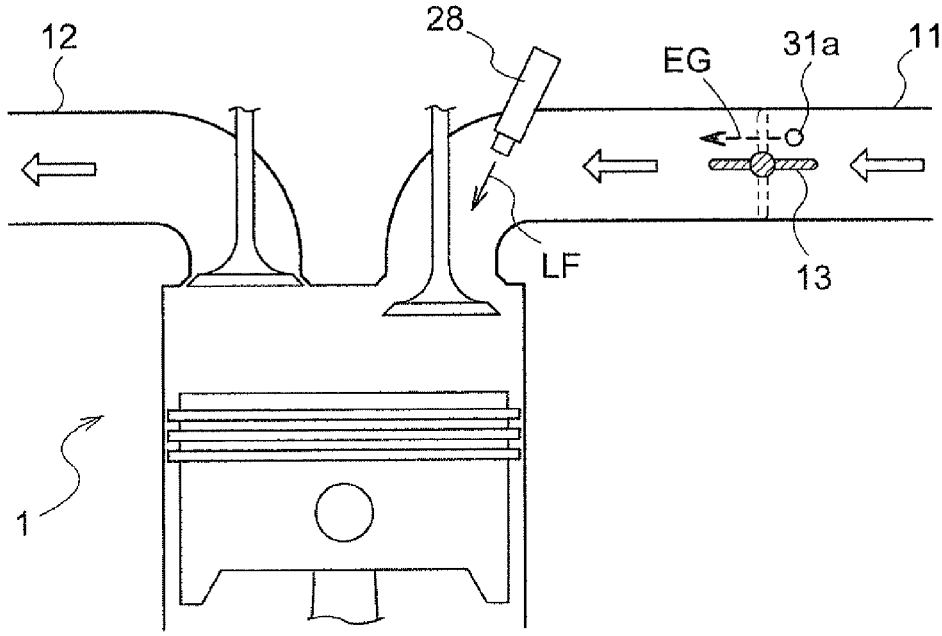
FIG. 5 is a schematic diagram showing an evaporated gas discharge port and surroundings thereof.

As shown in FIGS. 4 and 5, a throttle valve 13 as on-off valve is rotatably disposed in the second air-intake pipe 11. The second air-intake pipe 11 is opened or closed, by a control of the orientation of the throttle valve 13 in accordance with operational conditions of the engine. A method for controlling the throttle valve 13 is omitted here. When the engine 1 is operated with a higher load, the throttle valve 13 is oriented in a direction to fully open the second air-intake pipe 11, and when the engine 1 is operated with a lower load, the throttle valve 13 is oriented in a direction to close the second air-intake pipe 11.

(Fuel Tank)

Figure 6:
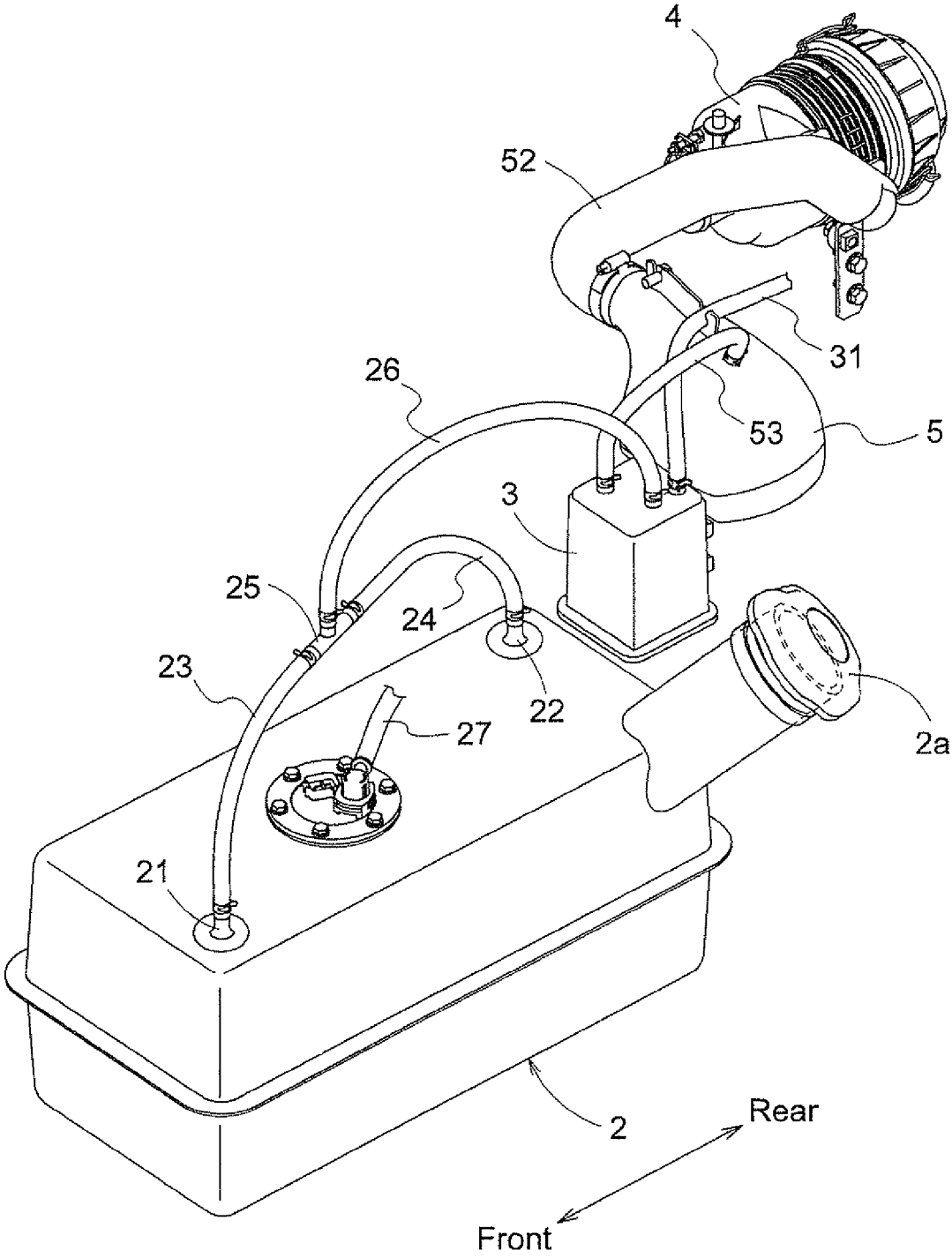
FIG. 6 is a front perspective view of the fuel tank and the surroundings thereof of the work vehicle.

As shown in FIGS. 2, 3 and 6, the fuel tank 2 is in a shape of an approximate rectangular cuboid. On a rear left corner of the upper face of the fuel tank 2, a fuel filler opening 2*a* obliquely protrudes in an upper left direction from the fuel tank 2 is provided. In other words, the fuel filler opening 2*a* is located higher than the upper face of the fuel tank 2. Like the feed-water inlet 88*a* of the radiator 88, the fuel filler opening 2*a* is positioned in the space below the loading platform 87, or the space spanning below the loading platform 87 and the seat 84. Accordingly, improper opening and closing operations of the fuel filler opening 2*a* can be prevented.

As shown in FIG. 5, a fuel injection device 28 oriented to the engine 1 is disposed downstream of the throttle valve 13 in the second air-intake pipe 11 and the gasoline LF in the fuel tank 2 is sent to the fuel injection device 28 through a fuel pipe 27. The gasoline LF in an amount in accordance with the operational condition of the engine is sprayed from the fuel injection device 28 into the second air-intake pipe 11. The sprayed gasoline LF is appropriately mixed with combustion air from the air cleaner 4, and the mixture is combusted in the engine 1. An exhaust gas generated by the combustion is released to the atmosphere through an exhaust path 12 and then the above-described the muffler 90. It should be noted that the supply means of the gasoline LF to the engine 1 is not limited to the fuel injection device 28, and may be a carburetor.

Figure 8A:
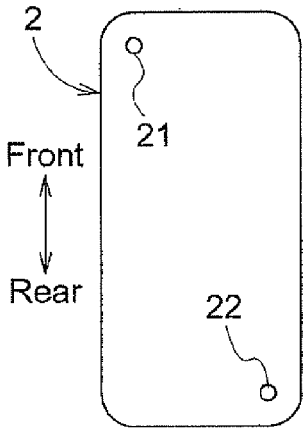
FIG. 8*a* is a plan view showing a layout of a first port and a second port.

As shown in FIG. 8*a*, the upper face of the fuel tank 2 is provided with a first port 21 and a second port 22. The first port 21 is positioned on a left-front side relative to the vehicle body. The second port 22 is positioned on a right-rear side relative to the vehicle body. In other words, the first port 21 and the second port 22 are formed in the upper face of the fuel tank 2 on the front side and rear side relative to the vehicle body, respectively, while they differ in lateral positions relative to the vehicle body. As shown in FIGS. 4 and 6, a first conduit 23 is connected to the first port 21, while a second conduit 24 is connected to the second port 22. The first conduit 23 and the second conduit 24 join together at a joint 25 as merging part, which is further connected to a confluent conduit 26. The confluent conduit 26 is connected to the canister 3. The first conduit 23, the second conduit 24 and the confluent conduit 26 correspond to an inflow line.

Figure 9A:
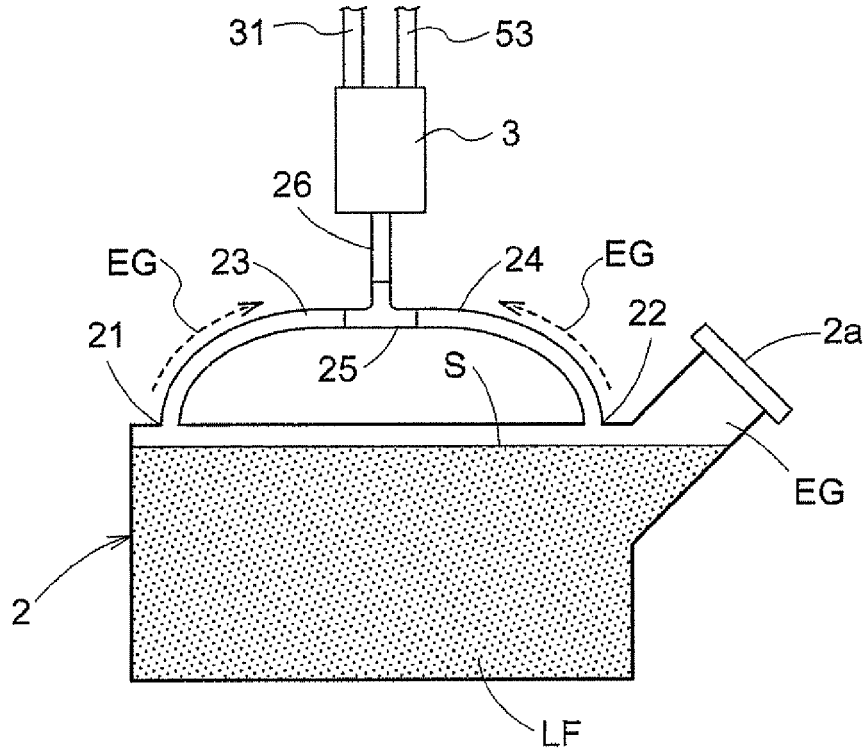
FIG. 9*a* is a schematic diagram showing a condition of the fuel tank and the surroundings thereof when the vehicle is in a horizontal state.
Figure 9B:
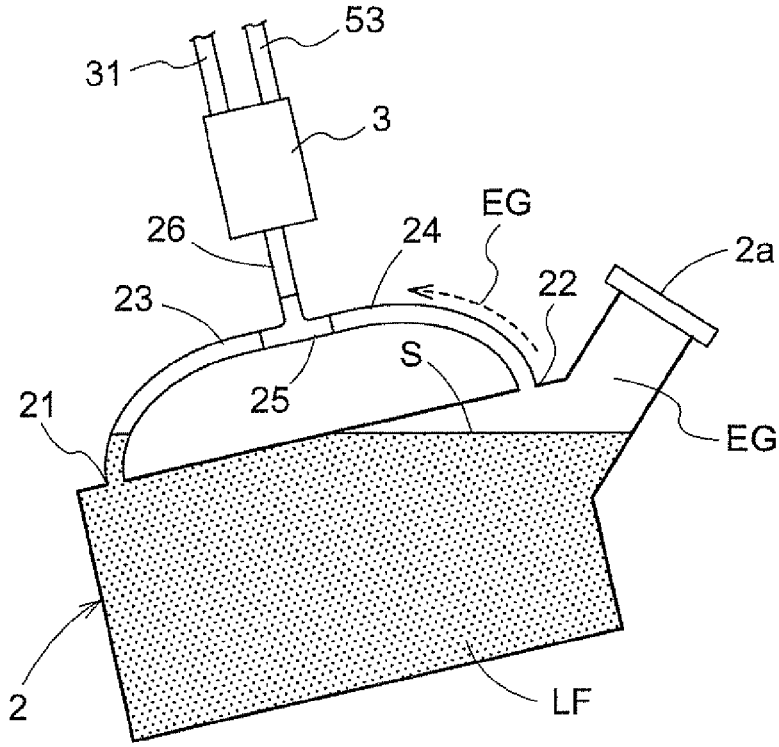
FIG. 9*b* is a schematic diagram showing a condition of the fuel tank and the surroundings thereof when the vehicle is inclined.

When the UV is in a horizontal state, the fuel tank 2 and the like are in a state as shown in FIG. 9*a*. When the UV comes to a down slope or the like, for example as shown in FIG. 9*b*, the fuel tank 2 is inclined with the front end down. The position of the second port 22 becomes higher than the position of the first port 21, and becomes highest among the portions of the fuel tank 2. Therefore, a fluid level S of the gasoline LF inside the fuel tank 2 becomes relatively higher than the first port 21, and relatively lower than the second port 22. Especially, when the fuel tank 2 is nearly filled with the gasoline LF and the slope is large, the first port 21 becomes blocked by the gasoline LF. However, even when the fuel tank 2 is filled with the gasoline LF, a gas such as the evaporated gas EG gathers in an upper portion of the fuel tank 2, i.e., near the second port 22, and as a result, the second port 22 is opened to the canister 3. Therefore, even though the UV is stopped in this state and then the gasoline LF is evaporated due to raise in an ambient temperature or the like, the evaporated gas EG enters the canister 3 and an inner pressure of the fuel tank 2 does not increase. Therefore, the gasoline LF in the first port 21 is prevented from reaching the canister 3, which may otherwise be caused by the increase in the inner pressure of the fuel tank 2.

Figure 8B:
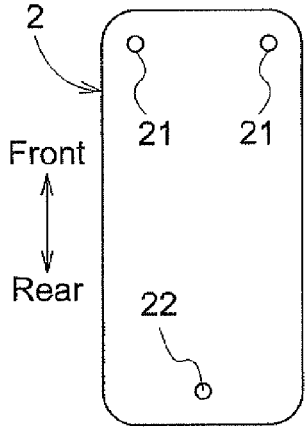
FIG. 8*b* is a plan view showing another layout of the first port and the second port.
Figure 8C:
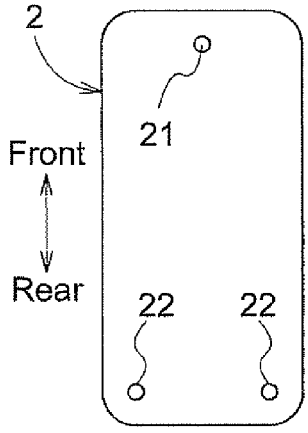
FIG. 8*c* is a plan view showing still another layout of the first port and the second port.

The first port 21 and the second port 22 are diagonally arranged on the upper face of the fuel tank 2 on the front side and rear side relative to the vehicle body, with their lateral positions relative to the vehicle body different from each other, and therefore, even when the vehicle body is inclined to any of longitudinal and lateral directions, one of the first port 21 and the second port 22 becomes the highest among the portions of the fuel tank 2. However, there is a case where the first port 21 and the second port 22 are retained at the approximately same height, even when the fuel tank 2 is inclined (for example, when an imaginary line that connects the first port 21 and the second port 22 is retained horizontal). In this case, both of the ports 21,22 may be blocked by the gasoline LF. Accordingly, as shown in FIGS. 8*b* and 8*c*, a plurality of the first port 21 and/or a plurality of the second port 22 may be provided. With this configuration, when the fuel tank 2 is inclined, any one of the ports is positioned highest among the portions of the fuel tank 2, and thus the port is not blocked by the gasoline LF.

If a position of the joint 25 becomes lower than the fluid level S in the fuel tank 2 when the fuel tank 2 is inclined, the gasoline LF may disadvantageously reach the joint 25. Therefore, the joint 25 is arranged higher than the fluid level S of the gasoline LF in the maximally inclined UV whose fuel tank 2 has been initially filled with the gasoline LF, with the proviso that the maximal angle of inclination of the UV is set. Accordingly, at least one of the first port 21 and the second port 22 is opened to the canister 3.

The first conduit 23 and the second conduit 24 are joined at the joint 25 and then directly connected to the canister 3. However, the first conduit 23 and the second conduit 24 may not be joined and may be separately and directly connected to the canister 3. In this case, the first conduit 23 and the second conduit 24 are joined inside the canister 3. Accordingly, the canister 3 is arranged higher than the fluid level S of the gasoline LF in the maximally inclined UV whose fuel tank 2 has been filled with the gasoline LF.

Though not shown, the second port 22 may be provided on the fuel filler opening 2*a*. Since the fuel filler opening 2*a* is positioned higher than the upper face of the fuel tank 2 as described above, especially when the fuel tank 2 is inclined rearward, the second port 22 is not likely to be blocked by the gasoline LF.

(Canister)

The canister 3 is, for example, a carbon canister containing carbon therein and is configured to adsorb the evaporated gas EG. To the canister 3 is connected the confluent conduit 26, and the evaporated gas EG is introduced to the canister 3 through at least one of the first conduit 23 and the second conduit 24, and then through the confluent conduit 26.

In order to prevent the functional loss of the canister 3 to adsorb the evaporated gas EG, the canister 3 is positioned closer to the fuel tank 2. In the present embodiment, as shown in FIGS. 2, 3 and 6, the canister 3 is disposed above the fuel tank 2. However, the position of the canister 3 is not limited to this position, and the canister 3 may be positioned on one side of the fuel tank 2, depending on the layout of the components.

As shown in FIGS. 4 and 6, the canister 3 and the pre-cleaner 5 are connected through a canister air-intake pipe 53. In addition, to the canister 3 is connected an evaporated gas discharge pipe 31 (as an element in a discharge line), which communicates with the second air-intake pipe 11. Therefore, in accordance with an air-intake step of the engine 1, ambient air cleaned in the pre-cleaner 5 is introduced to the canister 3, and together with the cleaned ambient air, the evaporated gas EG adsorbed to the canister 3 is discharged to the second air-intake pipe 11.

As shown in FIG. 5, the evaporated gas EG passed through the evaporated gas discharge pipe 31 is discharged from an evaporated gas discharge port 31*a* to the second air-intake pipe 11. The evaporated gas discharge port 31*a* is disposed upstream of the throttle valve 13 in the flow direction of intake air. Since the evaporated gas discharge port 31*a* is disposed upstream of the throttle valve 13 in the flow direction of intake air, in the case of a low-load operation in which a degree of opening or closing of the throttle valve 13 is small, the upstream side is not likely to be affected by the negative pressure caused in the air-intake step of the engine 1. In addition, since the opening degree of the throttle valve 13 is small, entry of the evaporated gas EG into a point downstream of the throttle valve 13 in the flow direction of intake air can be suppressed. Therefore, the evaporated gas EG is not likely to be introduced to the engine 1. In this manner, introduction of unnecessary evaporated gas EG to the engine 1 can be suppressed, and thus incomplete combustion is not likely to occur, which in turn suppresses excessive generation of CO or the like.

On the other hand, during a high-load operation of the engine, the opening degree of the throttle valve 13 is large, and therefore, the second air-intake pipe 11 opens wide, and the most of the evaporated gas EG together with the intake sir, is introduced to the engine 1. Even when the engine is operated with a higher load, introduction of the evaporated gas EG does not cause any problem, since an air-fuel ratio is set on a rich side.

In this manner, while retaining the normal function of the canister 3, by utilizing the negative pressure on the engine 1 side, the emission amount of the evaporated gas EG can be adjusted in accordance with the operational conditions of the engine 1, with a simple and low-cost structure.

In addition, since the air purified by the pre-cleaner 5 is introduced to the canister 3, the performance of adsorbing the evaporated gas EG by the canister 3 can be retained excellent for a long period of time. It should be noted that the pre-cleaner 5 can be omitted. Depending on the environment of the usage, installation of the pre-cleaner 5 becomes not necessary, and in such a case, ambient air is introduced directly to the canister 3.

Another Embodiment

An embodiment of the UV having a float valve as a valve operating mechanism will be described with reference to the drawings. Since the structure except the portions associated with the float valve is the same as or similar to that of the above-described embodiment, duplicate descriptions are omitted. Components having the same structures as those illustrated above are designated with the same reference characters.

Figure 11:
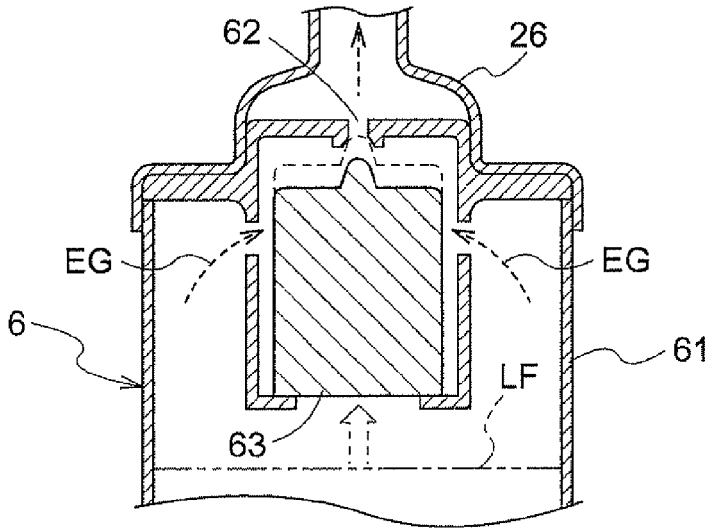
FIG. 11 is a vertical section of a float valve according to another embodiment.

As shown in FIG. 11, a float valve 6 has a case 61, a vent hole 62 formed in the case 61, and a floating piece 63 slidable along an inner periphery of the case 61. Normally, the floating piece 63 is positioned lower in the case 61, because of its own weight. In this case, the vent hole 62 is opened and the float valve 6 allows the gas to flow. On the other hand, when the liquid enters the case 61, the floating piece 63 floats in the liquid and moves higher in the case 61 together with the elevation of the fluid level, which eventually closes the vent hole 62. In other words, the float valve 6 allows a gas from below the case 61 to pass, while preventing a liquid from below the case 61 from passing.

Figure 10:
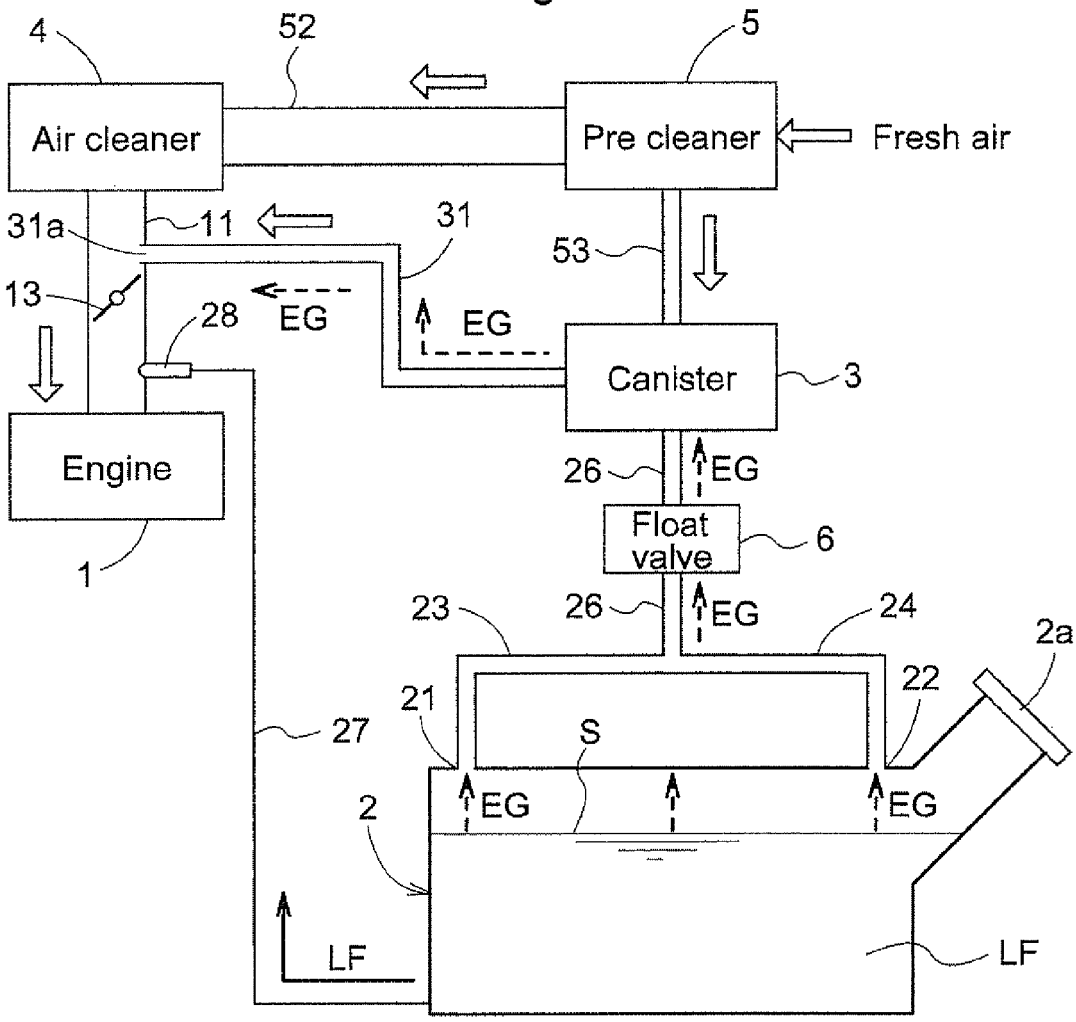
FIG. 10 is a block diagram showing a configuration of a fuel tank and a surroundings thereof of a work vehicle according to another embodiment.
Figure 12:
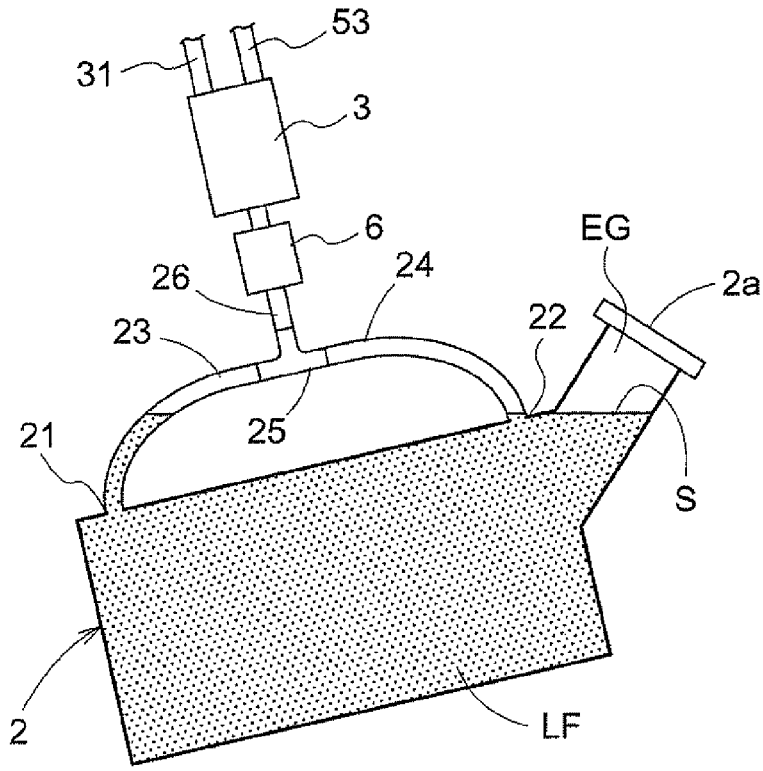
FIG. 12 is a schematic diagram showing the fuel tank and the surroundings thereof when a work vehicle according to another embodiment is inclined.
Figure 13:
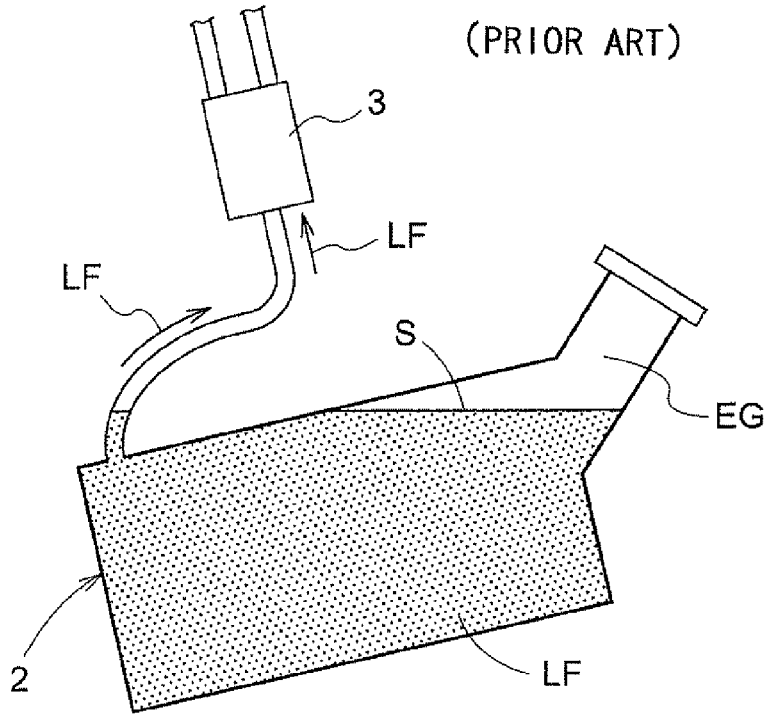
FIG. 13 is an explanatory diagram illustrating problems in the conventional fuel system.

As shown in FIGS. 10 and 12, the float valve 6 is disposed between the canister 3 and the joint 25, i.e., on an intermediate portion of the confluent conduit 26. The float valve 6 is arranged in such a manner that an upper side is oriented to the canister 3 and a lower side is oriented to the fuel tank 2.

For example, in the case where the gasoline LF in an amount larger than the defined full amount is put in the fuel tank 2, only a small degree of inclination of the fuel tank 2 may lead to the blocking of both first port 21 and second port 22 by the gasoline LF, as shown in FIG. 12.

In this case, when the gasoline LF in the fuel tank 2 is evaporated due to raise in an ambient temperature or the like, an inner pressure of the fuel tank 2 increases, which may cause the gasoline LF to reach the float valve 6 through the first conduit 23 or the second conduit 24. However, when the float valve 6 is present, the floating piece 63 closes the vent hole 62, which prevents the gasoline LF from advancing further to the canister 3, thus from entering the canister 3. In addition, since the float valve 6 is disposed after the junction of the first conduit 23 with the second conduit 24, only a single float valve 6 is required.

The fuel system according to the present invention with a simple and low-cost structure retains the function of the canister and surely adjusts the emission amount of the fuel vapor, and therefore, is applicable to a wide range of vehicles, such as UV, work vehicles including tractor and riding type combine, and industrial vehicles including backhoe.

What is claimed is:

1. A fuel system for a vehicle with an engine comprising:

a fuel tank configured to store fuel;

a first port and a second port disposed on a boundary wall of the fuel tank, between which boundary wall and a fluid level of the fuel a clearance is created when the fuel is contained in an allowable maximal amount in the fuel tank of the vehicle in a horizontal state, the first port being positioned frontward in a longitudinal direction of the vehicle, the second port being positioned rearward in the longitudinal direction of the vehicle, and the first port and the second port being out of alignment in a lateral direction of the vehicle;

a canister configured to adsorb and release a fuel vapor;

a discharge line configured to send the fuel vapor discharged from the canister to an air-intake path to the engine; and an inflow line configured to send the fuel vapor generated in the fuel tank to the canister through the first port and the second port, wherein the inflow line comprises:

a confluent conduit with one end thereof being connected to the canister, the confluent conduit being configured to prevent the fuel in a liquid form from the fuel tank from entering the canister;

a first conduit for connecting the other end of the confluent conduit to the first port; and a second conduit for connecting said other end of the confluent conduit to the second port.

2. The fuel system according to claim 1, wherein positions of the first port and the second port in the longitudinal direction of the vehicle are defined so that a clearance is created between the fluid level of the fuel and at least one of the first port and the second port, when the fuel tank contains the fuel in an allowable maximal amount and the vehicle is in an allowable maximal longitudinally inclined state.

3. The fuel system according to claim 1, wherein positions of the first port and the second port in the lateral direction of the vehicle are defined so that a clearance is created between the fluid level of the fuel and at least one of the first port and the second port, when the fuel tank contains the fuel in an allowable maximal amount and the vehicle is in an allowable maximal laterally inclined state.

4. The fuel system according to claim 1, wherein the confluent conduit comprises a valve operating mechanism configured to prevent the fuel in the liquid form from the fuel tank from entering the canister.

5. The fuel system according to claim 4, wherein the valve operating mechanism is a float valve.

6. The fuel system according to claim 1 further comprising an air cleaner disposed upstream of the air-intake path, wherein an on-off valve configured to adjust an intake volume from the air cleaner to the engine is disposed on the air-intake path, and the discharge line is a fuel vapor discharge pipe, with one end thereof being connected to the canister and the other end being connected to the air-intake path at a position upstream of the on-off valve in a flow direction of intake air.

7. The fuel system according to claim 1, wherein the canister includes a cleaner.

* * * * *